United States Patent [19]

Araya

[11] Patent Number: 4,829,631

[45] Date of Patent: May 16, 1989

[54] SUSPENDED TRAVEL DEVICE FOR PANELS

[75] Inventor: Kuniharu Araya, Kaga, Japan

[73] Assignee: Comany Co., Ltd., Ishikawa, Japan

[21] Appl. No.: 205,171

[22] Filed: Jun. 10, 1988

[30] Foreign Application Priority Data

Feb. 10, 1988 [JP] Japan ..... 63-29529

[51] Int. Cl.[4] ..... E05D 15/16

[52] U.S. Cl. ..... 16/95 R; 16/87 R; 16/102; 49/409; 104/105; 104/130

[58] Field of Search ..... 16/87 R, 89, 91, 97, 16/98, 102, 106, 93 R, 94 R, 107; 49/409–412; 104/100, 101, 105, 130; 160/345, 346, 347

[56] References Cited

U.S. PATENT DOCUMENTS

| | | | |
|---|---|---|---|
| 3,708,916 | 1/1973 | Karp, Jr. et al. | 16/97 |
| 3,843,995 | 10/1974 | Merrill | 16/97 |
| 4,245,440 | 1/1981 | Oase | 16/87 R |
| 4,555,828 | 12/1985 | Matimura | 16/87 R |

FOREIGN PATENT DOCUMENTS

| | | |
|---|---|---|
| 20496 | of 1975 | Japan . |
| 24288 | of 1980 | Japan . |
| 7114 | of 1985 | Japan . |
| 7116 | of 1985 | Japan . |
| 17062 | of 1987 | Japan . |

*Primary Examiner*—Nicholas P. Godici
*Assistant Examiner*—Edward A. Brown
*Attorney, Agent, or Firm*—Rodman & Rodman

[57] ABSTRACT

The suspended travel device for panels includes traveling rails, crossing rails provided where the traveling rails cross each other (in a cross-like manner), and suspended vehicles suspended from these rails and adapted to travel and turn along the rails. The crossing rail is equipped with wheel bottom walls arranged substantially at the same height as wheel bottom surfaces of traveling rail, reception wheels arranged in a direction inclined with respect to the traveling direction of a vehicle body and vehicle bases adapted to rotatably support the reception wheels.

6 Claims, 7 Drawing Sheets

SUSPENDED TRAVEL DEVICE FOR PANELS

BACKGROUND OF THE INVENTION

1. Field of the Invention

This invention relates to suspended vehicles adapted to run (move) suspended movable partition wall panels (hereinafter referred to as panels) as well as traveling and crossing rails for such a vehicle. More particularly, this invention relates to a suspended travel device which makes it possible to turn heavy panels with ease.

2. Description of the Related Art

Conventionally, suspended travel devices used for suspending and moving panels are of two types: one is a vertical wheel type which comprises horizontally elongated traveling rails each having a U-shaped cross-section open at the bottom. The sides of the rail are bent at the open ends inwardly and squarely, the end portions extending inwardly to form wheel bottom surfaces, leaving between them a space as a sliding groove. The traveling rail thus formed is installed near the ceiling of a room. A suspended vehicle with wheels rotatable in the vertical direction as those of a cart is installed inside the traveling rail, with its wheels being on the wheel base surfaces. A suspension axis which is to be connected with the upper end surface of a panel is suspended through the sliding groove from the vehicle body.

The other is a horizontal wheel type in which a suspension axis which is to be connected with a panel includes horizontal wheels directly mounted thereon.

Generally, what is required of such suspended travel devices are a stable traveling and an easy turning of the suspended vehicle. It is necessary for the vehicle to be turned when the relevant panel is to be moved for constituting the new partition or canceling the same.

The first type of suspended travel device, i.e., the vertical wheel type excels in the panel weight bearing capacity. However, its ability to make a turn, especially a square one, is rather poor. On the other hand, the second type with horizontal wheels offers a satisfactory ability to make a turn, especially a square one, but it is not suited to bear heavy panels. Examples of the former are disclosed in Japanese Patent Publications Nos. 50-20496, 60-7114, 60-7116, etc., and examples of the latter are disclosed in Japanese Utility Model Publication No. 55-24288, etc.

The problem with these prior art devices first lies in the fact that the suspension axis is hard to be held vertically in the sliding groove during the straight movement along the traveling rail. In the first type, the vertical wheels are liable to rub or hit against the inner walls of the traveling rail. In the second type, each of the horizontal wheels support the panel weight at a point on the lower surface thereof, so that it is apt to snake over the wheel bottom surface. In view of this, it has been attempted in the above described prior art to assure a balanced travel state for the suspended vehicle by a complicated configuration of the wheel sheath or by provision of induction wheels, but no satisfactory result has been obtained yet, which is especially the case with devices for heavier panels. This is mainly due to the excessively great rising height of the suspended vehicle and its large dimension in the transverse direction.

As for the panel turning in the traveling rail, it is conventionally effected, in the case of a vertical wheel type suspended travel device, by providing at each crossing (branching) section a line gently curved with respect to the straight rail section. In a horizontal wheel type suspended travel device, turning is effected by a square crossing of the rails. Recently, more and more vertical wheel type devices have come to employ the square crossing method in view of the convenience in arranging panels as well as from the aesthetic point of view. In an example of such a construction, a vertical wheel is mounted on each of the four side surfaces of a parallelepiped vehicle body (as disclosed, for example, in Japanese Patent Publication No. 62-17062).

The present invention is directed to this kind of suspended travel vehicle, i.e. the one in which the vertical wheels and the square crossing method are combined.

Whether in the curve turning method with a curved line or in the square turning method, rails of the same configuration are to be integrally formed in a continuous configuration, with the bottom opening thereof being directed downwardly, so that, at a crossing rail section, the wheel base surfaces are in an interrupted condition, the wheel sheath being enlarged and a large inner space left in the section. As a result, the wheels, not supported by the wheel bottom surfaces, are inclined, so that the suspended vehicle becomes unstable in the wheel sheath thus enlarged, so that its body or wheels are apt to come off the path to get in the sliding groove or hit against the inner walls of the wheel sheath.

To cope with this, a contrivance has been proposed in the prior art device regarding the square turning of the vertical wheels (Japanese Patent Publication No. 62-17062). According to this contrivance, the vertical wheels are not used in the crossing sections, i.e. they are kept in the air while the vehicle is traveling along crossing rail sections. Instead, large balls (made of steel) are provided in four corners of the upper portion or lower portion of the vehicle body for sustaining the suspended vehicle at the crossing sections. The problem with this prior art device is that when balls are provided at the lower position of the vehicle, they are hard maintain at the same height as the wheel bottom surfaces and that when they are provided at an upper position of the vehicle, a satisfactory engagement is hardly attained between the balls and the suspension columns in the crossing section. Further, the ball and the traveling rail are only in a point contact with each other, so that a smooth rotation cannot be effected. As far as the direct movement along the traveling rail is concerned, the body of the vehicle of this prior art device effectively prevents the suspended vehicle from swaying because of its configuration fully occupying the wheel sheath of the traveling rail and provides a satisfactory running condition by small horizontal wheels adapted to rotate as they operatively engaged with the rail walls. In the crossing rail sections, on the other hand, the enlargement as mentioned above of the wheel sheath makes the horizontal guide wheels useless, so that unless the panel is accurately pushed ahead, the suspended vehicle cannot be made to move in the intended direction, because the rotations of the balls are not regulated.

Moreover, such balls cannot offer a sufficient capacity for bearing heavy panels. For heavier panels with a weight over 100 kg, especially for those with a weight over 500 kg, the above described contrivance is not suited. Generally speaking, the traveling problems in the crossing sections of a suspended travel device have not been overcome yet.

SUMMARY OF THE INVENTION

Accordingly, it is an object of this invention to obviate the above problems in the conventional suspended travel devices and to meet the above requirements, thereby providing a reliable and smooth operation of suspending and running panels.

In accordance with this invention, the parallelepiped vehicle body having a horizontally elongated longitudinal section occupies approximately the entire cross section of the wheel sheath during a straight movement along the traveling rail, the vehicle body including vertical wheels mounted on the wheel mounting sections provided by cutting away the central portions of the four side surfaces of the body, two transverse vertical wheels being placed on wheel bottom surfaces, two longitudinal vertical wheels being held in the air during the straight movement along the traveling rail, all four wheels being of a diameter corresponding to the width of a sliding groove of the traveling rail. In a crossing rail section generally formed as the traveling rails squarely crossed each other, the vehicle advances, guided by guide projections provided in the roof of the crossing rail section being engaged with guide grooves cut lattice-like on the top surface of the vehicle body. The movement of the vehicle then does not involve a vertical movement of the body, the transverse vertical wheels being placed on wheel bottom walls provided in crossing rail base sections, the vehicle body being successively supported by two or four reception wheels provided in a direction inclined with respect to the traveling direction of the suspended vehicle, thus leading the suspended vehicle to a crossing section opening, with the four vertical wheels in the sliding groove. In effecting a square turn in the crossing section, two longitudinal vertical wheels are placed on the opposite wheel bottom walls, respectively. In passing the crossing section straightly, two transverse vertical wheels are placed on the opposite wheel bottom walls, respectively. The body is guided by the guide projections and is then gradually released from the support of the reception wheels, the two vertical wheels moving from the wheel bottom walls to the wheel bottom surfaces.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENTS

Figure 1:
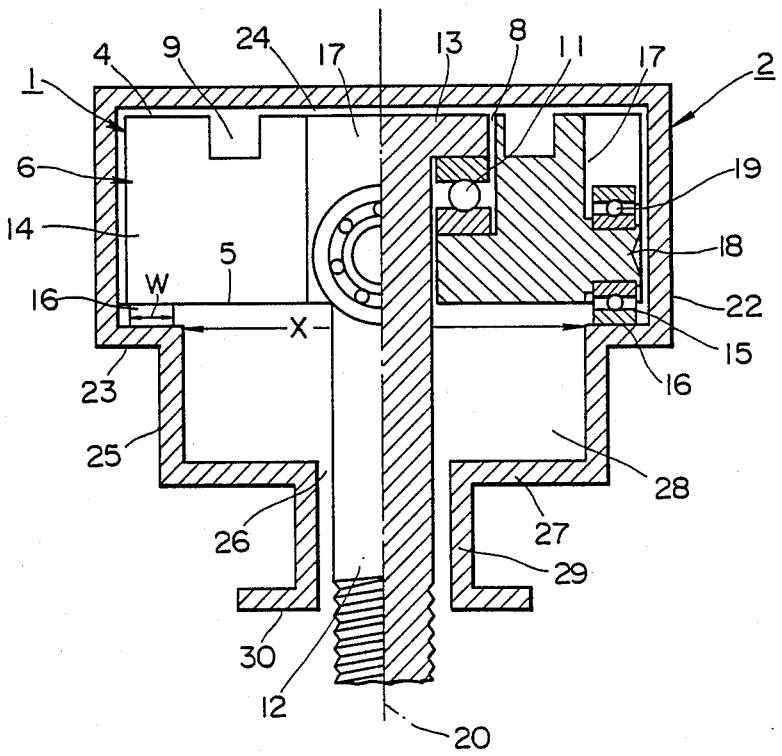
FIG. 1 is a partially cutaway longitudinal section of a suspended vehicle and a traveling rail in accordance with this invention.
Figure 2:
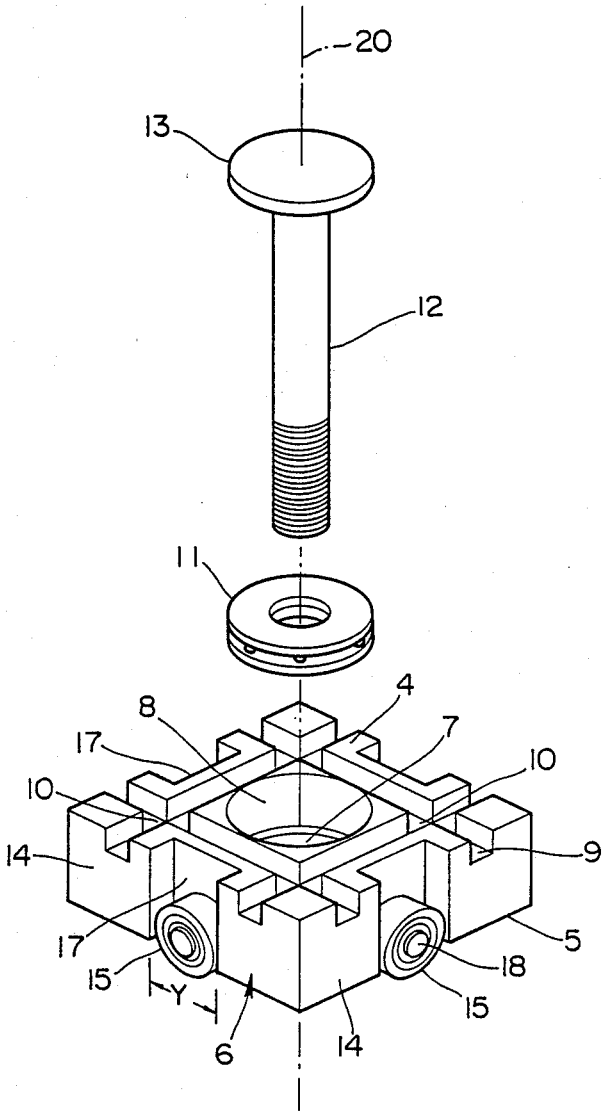
FIG. 2 is a perspective view showing the construction of the suspended vehicle.

Referring to the drawings, a suspended vehicle 1 composing the suspended travel device in accordance with this invention is shown mainly in FIGS. 1 and 2. A traveling rail 2 is shown in FIG. 1 and a crossing rail 3 in FIGS. 3 and 4.

The suspended vehicle 1 is made of a hard material such as metal and composed of a parallelepiped body 6 having a top surface 4 and a bottom surface 5 which are wide and square. The body 6 has a horizontally elongated longitudinal section. The body 6 further includes a round through-hole 7 extending from the center of the top surface 4 and passing the bottom surface 5. A countersink 8 concentric with the throughhole 7 is provided in the top surface 4 of the body 6 as a flat cylindrical recess. Lattice-like guide grooves 9, 9 lying at right angles to each other and having a rectangular longitudinal section are cut over the full length of the top surface 4, with the countersink 8 surrounded by them. The positions where the guide grooves 9, 9 cross each other will be referred to as crossing points 10. A ball thrust bearing 11 is arranged in the countersink 8 and a suspension axis 12 consisting of a round bar-like component is inserted into the through-hole 7. The suspension axis 12 extends downwardly beyond the bottom surface 5 of the body 6, the axis head 13 thereof being received in the countersink 8 in such an manner that its top surface is flush with the top surface 4 of the body 6. The suspension axis 12 is then fixed rotatably at the bottom surface 5 of the body 6.

In the middle positions of side surfaces 14, 14, 14, 14 of the body 6 are provided wheel mounting sections 17, 17, 17, 17, each of which is in contact with or spaced from the guide grooves 9, 9 on both sides thereof and extends from the top surface 4 to the bottom surface 5. They are cut inwardly and squarely, with a depth substantially corresponding to the width (W) of the running surface 16 of a vertical wheel 15, which is to be described later. An axle 18 is outwardly protruding from a center of width of each wheel mounting section 17 in such a manner that its end is substantially flush with the corresponding side surface 14.

The vertical wheels 15, 15, 15, 15, each containing a radial ball thrust bearing 19, are rotatably fixed to the axles 18, 18, 18, 18, respectively, in such a manner that each wheel 15 is substantially flush with the corresponding side surface 14 and slightly protruding beyond the bottom surface 5 of the body 6, without being in contact with a sliding groove 26, described below, of the traveling rail. Such is the construction of the suspended vehicle in accordance with this invention.

As shown in FIG. 2, the suspended vehicle 1 is well-balanced in all directions with respect to the center line 20 thereof.

The traveling rail 2 is made of a hard material such as metal and composed of a horizontally elongated rail member 21 with a U-shaped cross-section, open at the bottom. The side surfaces 22, 22 of the rail member 21 are bent inwardly and squarely at the open bottom ends, to provide wheel bottom surfaces 23 with a width slightly larger than that (W) of the running surfaces 16 of the wheels 15 of the suspended vehicle 1. The wheel bottom surfaces 23 extend horizontally, leaving between them a space corresponding to the distance X between the opposite wheel mounting sections 17 of the body 6 of the suspended vehicle 1. Thus, the U-shaped traveling rail forms a wheel sheath 24. The open ends of the wheel bottom surfaces 23 are bent downwardly and squarely, to form lower side surfaces 25, 25 horizontally elongated. The open ends of the lower side surfaces 25 are bent inwardly and squarely and allowed to extend horizontally, defining between them a sliding groove 26 with a width corresponding to the wheel diameter (Y) of the vertical wheel 15 of the suspended vehicle 1 and forming lower reception parts 27. The frame sections composed of the lower side surfaces 25 and the lower reception parts 27 form rail base sections 28. The lower reception parts 27 may be further bent at the open ends downwardly and squarely, to extend downwards with a length corresponding to thickness of a ceiling panel (not shown), thus forming sliding groove walls 29, 29. Ceiling panel receiving sections 30, 30 may or may not be formed by bending the sliding groove walls 29 outwardly and squarely, allowing them to slightly extend in the horizontal direction. Such is the construction of the traveling rail 2 in accordance with this invention.

The crossing rail 3 will now be explained referring to FIGS. 3 and 4. This crossing rail 3 is generally formed as traveling rails 2, 2 crossed each other at right angles, where the sliding grooves 26, 26, 26, 26 are also crossed each other at right angle having a crossing opening 31 lying in the center.

A crossing wheel sheath 34 is formed in the crossing rail 3 by downwardly extending the side surfaces 22, 22, adjacent to each other, to form side surface extensions 32, 32 and by connecting these side surface extensions 32, 32 with lower reception part extensions 33, 33 of the lower reception parts 27 extending horizontally. In the crossing wheel sheath 34 are provided wheel bottom walls 35 rising from the reception part extensions 33 and composed of small wall components having a height and a width (W),corresponding to that of the wheel bottom surface 23. The wheel bottom walls 35 are connected flush with the wheel bottom surfaces 23 of the traveling rails 2 crossing each other, are in contact with the side surface extensions 32, and protrude up to the vicinity of the sliding grooves 26, thus, integrally with the side surface extensions 32 and the lower reception part extentions 33, forming crossing rail base sections 36.

A vehicle body base 40 is positioned and fixed inside a frame defined by the wheel bottom walls 35, 35 of the crossing rail base sections 36, without allowing it to protrude into the sliding grooves 26,26 crossing each other. This vehicle body base 40 comprises small isosceles right triangular prism 37 made of a hard material such as metal, an axle **18*a* protruding from the center of the triangular-cross-sectioned base surface 38 of the prism 37, outwardly, i.e., in a direction lying substantially at 45 degrees with respect to the crossing direction (traveling direction of the suspended vehicle 1 and the body 6), and a reception wheel 39 utilizing a radial ball bearing 19*a* which is mounted on the axle 18*a*. Two or four vehicle body bases 40 are provided, opposite to the crossing opening 31, the axles 18*a*, 18*a* opening 31 or inversely oriented. In arranging these components, the top surface of the small triangular prism 37 is positioned considerably lower than the top surface of the wheel bottom walls 35, and the reception wheel 39 is rotatably fixed, protruding considerably higher than the top surface of the small triangular prism 37 and the wheel bottom walls 35, and being situated above the lower reception part extensions 33 of the crossing rail base sections 36. When the axle 18 is directed toward the crossing opening 31, it is advisable, as in this embodiment, that the isosceles sections 41 be in contact with the wheel bottom walls 35, 35, and when oriented inversely, the isosceles sections 41 may preferably be in contact with the sliding grooves 26, 26**.

Further, small cylindrical guide projections 43, 43, 43, 43 protrude into the crossing wheel sheath 34 from the four corner sections of the roof 42 of the rail crossing section and are fixed there. These small cylindrical guide projections 43, 43, 43, 43 protrude vertically in the positions corresponding to the crossing points 10, 10, 10, 10 in the guide grooves 9, 9 of the suspended vehicle 1 when suspension axis 12 of the vehicle is positioned in the crossing opening 31. The degree of protrusion of the guide projections 43 is such that they can be engaged with and fit into the guide grooves 9. FIG. 4 is a view of the crossing rail 3 as seen in the cross section taken along the line A—A of FIG. 3.

Such is the construction of the crossing rail 3.

Figure 5:
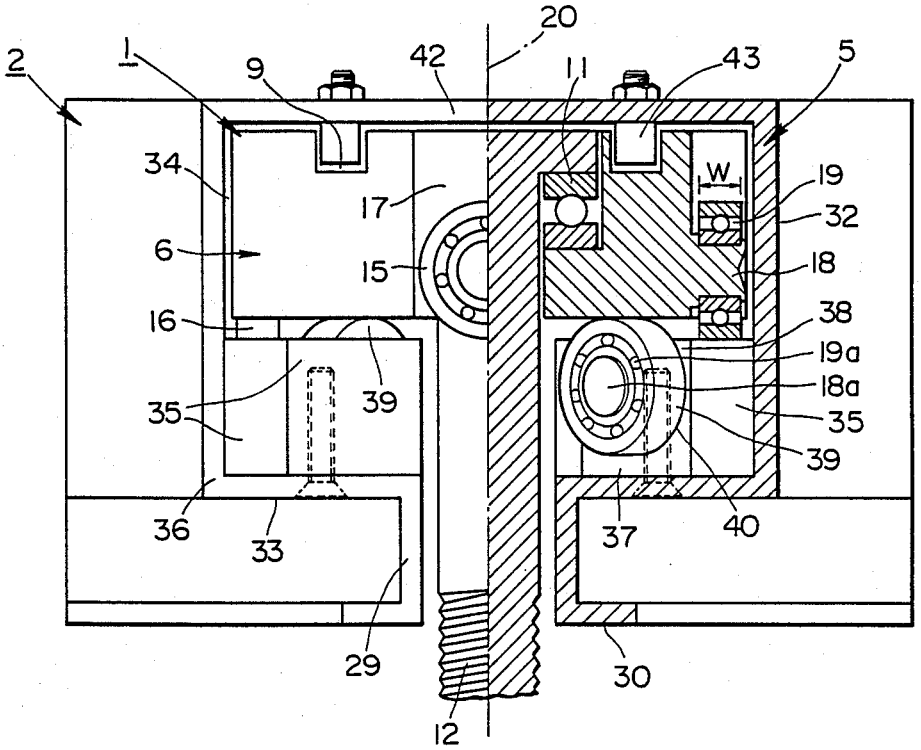
FIG. 5 is a longitudinal half section illustrating the mode of engagement between the suspended vehicle and the crossing rail.

The operation and effects of the present invention will now be explained referring to all of the attached drawings, and especially to FIG. 1 and FIGS. 5–7. The state where the suspended vehicle 1 is incorporated into the traveling rail 2 is shown in FIG. 1, and the state of the same incorporated into the crossing rail 3 is shown in FIG. 5.

First, the traveling rails 2 are installed near a ceiling lengthwise and crosswise, at right angles, with the sliding grooves 26 open downwardly. Where the rails 2 cross each other, the crossing rails 3 are arranged, the corresponding portions adjacent to or abutting against each other (e.g. between the sliding grooves 26,26) being connected and fixed together, with the exception that the lower side surfaces 25 are connected with the side surface extensions 32.

As shown in FIG. 1, a suspended vehicle 1 is brought into the wheel sheath 24 of a traveling rail 2, the transverse vertical wheels 15, 15 being disposed on the wheel bottom surfaces 23, 23 the longitudinal vertical wheels 15, 15 being raised above the rail base sections 28. At the same time, the suspension axis 12 is suspended through the sliding groove 26, the suspension axes 12, 12 of two suspended vehicles 1, 1 being rotatably connected to two longitudinal positions (not shown) on the upper end surface of a panel, respectively.

In this condition, as shown in FIG. 1, the body 6 of the suspended vehicle 1 occupies, substantially the entire wheel sheath 24 of the traveling rail 2, so that when the panel is being pushed along, and the transverse vertical wheels 15 are rotated, the vehicle never hits against the inner walls of the wheel sheath 24, nor do the wheels come off the path, thereby assuring a stable, satisfactory travel condition, well-balanced with respect to the center line 20. The vertical wheels 15 containing radial ball bearings 19 have a sufficient capacity for bearing heavy panels with weights such as 1 t and 5 t. Each of the vertical wheels 15 in this embodiment can withstand the weight of 500 kg. The bearing capacity can be further augmented by increasing the dimensions of the wheel. The wheel diameter (Y) of the vertical wheel 15 can be easily augmented because of the construction of the wheel mounting sections 17 of this invention. The suspended vehicle 1 is neither excessively high nor horizontally elongated, substantially remaining in a size within the dimensions of the body 6 with a square top surface.

Figure 6:
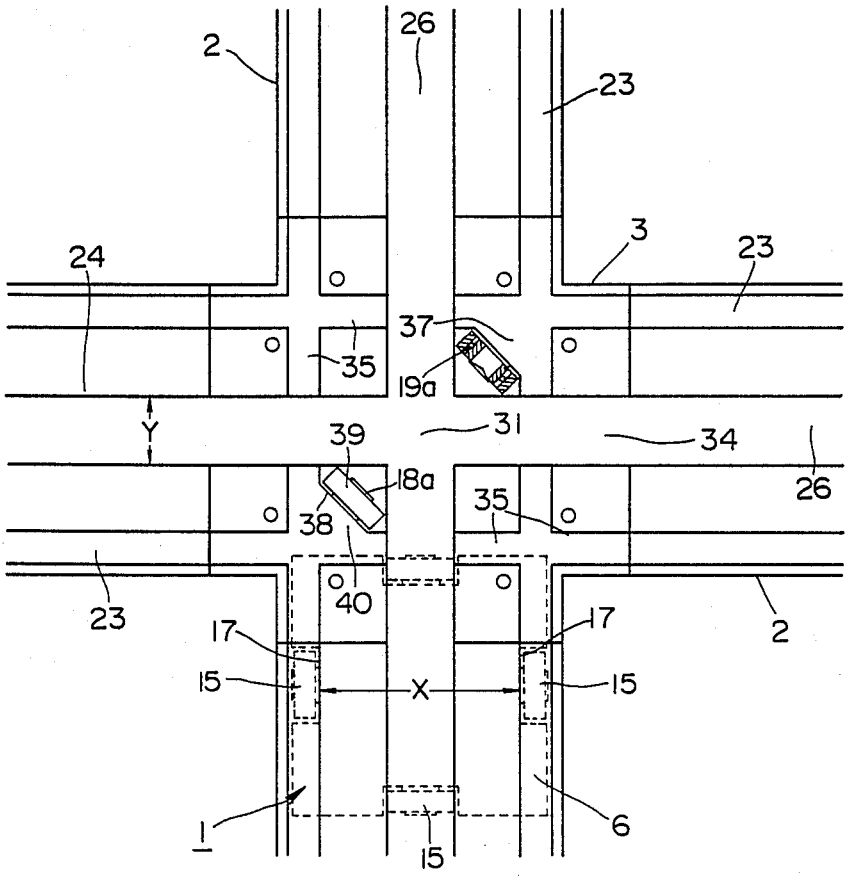
FIGS. 6 and 7 are views illustrating the relation between the suspended vehicle and the crossing rail as seen in the cross sectional direction.
Figure 7:
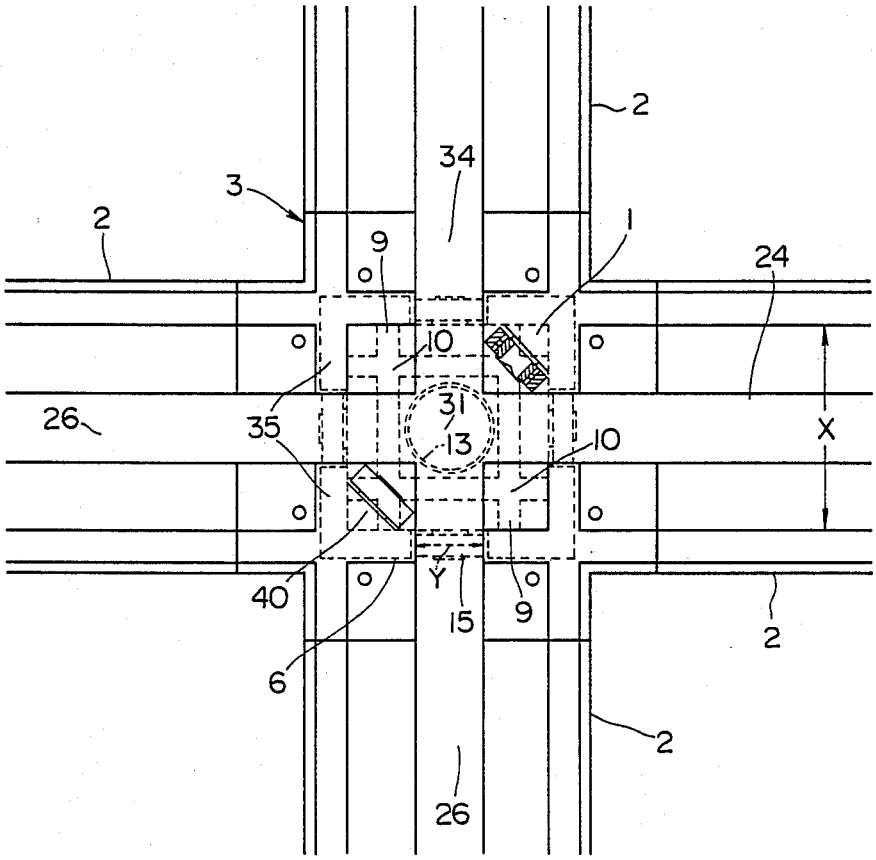

When the suspended panel is brought to a crossing rail 3, the transverse vertical wheels 15, 15 move, as shown in FIGS. 5 to 7, from the wheel bottom surfaces 23, 23 to the wheel bottom walls 35, 35, without vertical movement of the body 6. At the same time, the body is successively supported by the reception wheels 39 of the crossing rail base sections 36, and moves along, allowing the guide projections 43, 43, 43, 43 to engage with the guide grooves 9, 9; the guide projections 43, 43, 43, 43 come to be engaged with the crossing points 10, 10, 10, 10 of the guide grooves 9; the transverse and longitudinal vertical wheels 15, 15, 15, 15 are held in the air, above the crossing rail base sections 36 and above the sliding grooves 26, the suspended vehicle 1 (suspension axis 12) then reaching the crossing opening 31.

In accordance with this invention, the suspended vehicle 1 in this condition does not receive any impact due to the interruption of the wheel bottom surface 23 during the movement. The positioning of the reception wheel 39 up to the height of the bottom surface 5 of the body 6 can avoid a vertical movement of the suspended vehicle 1 (body 6) at the crossing rail 3. Whether the suspended vehicle 1 continues moving in the same direction or turns squarely, the vertical wheels 15, 15 are situated near and opposite the wheel bottom walls 35, 35 in the respective directions; in the case of straight movement, the transverse vertical wheels 15, 15 are placed on the wheel bottom walls 35, 35, and in the case of a square turning, the longitudinal vertical wheels 15, 15 are placed on the wheel bottom walls 35, 35. Guided at the same time by the guide projections 43, 43, 43, 43 and released gradually from the support by the wheels 39, 39 . . . , the suspended vehicle 1 moves to the wheel bottom surfaces 23, 23, thus passing the crossing section accurately and safely.

Figure 3:
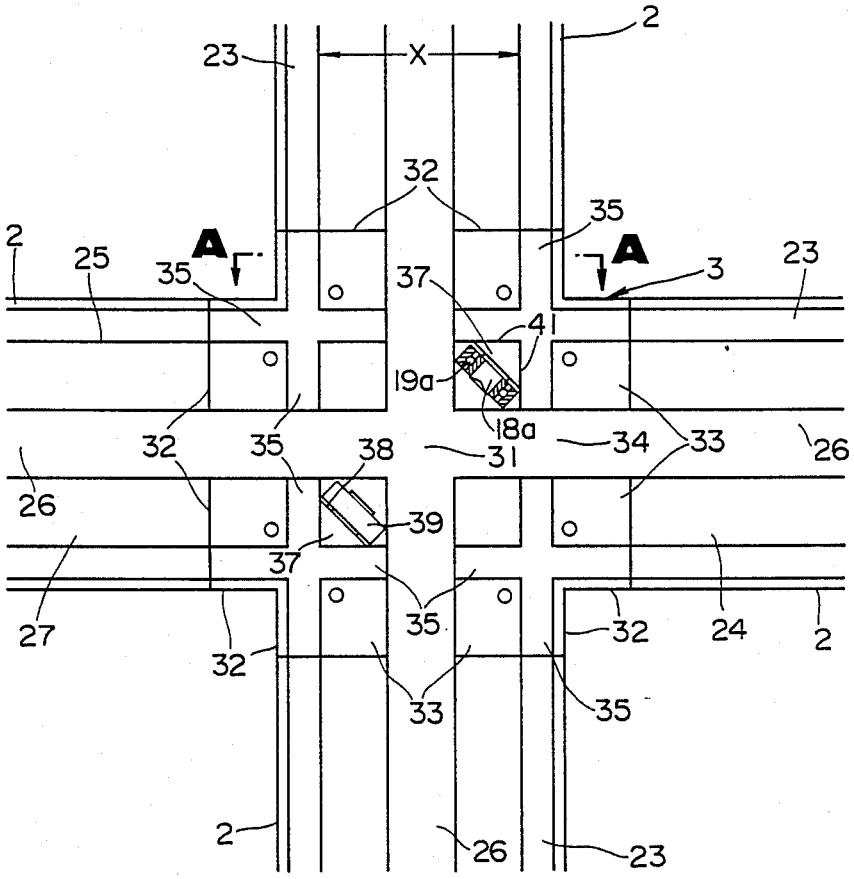
FIG. 3 is a partially cutaway cross-section showing the construction of the crossing rail.
Figure 4:
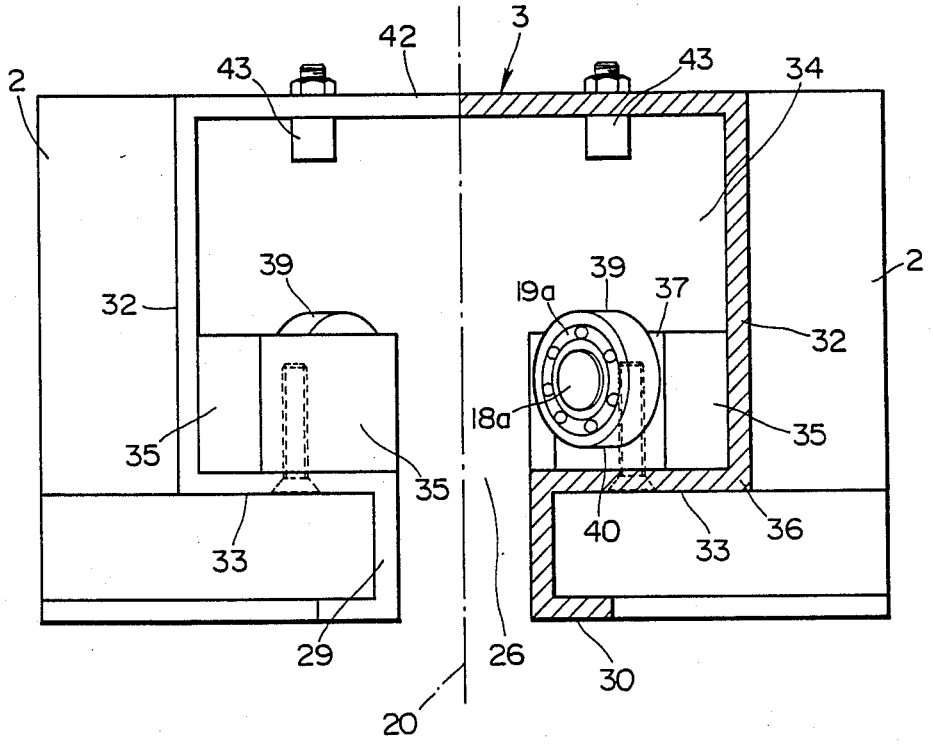
FIG. 4 is a longitudinal half section of the same.

As shown in FIG. 3, two or four reception wheels 39, 39 . . . are arranged opposite to each other linearly or crosswise in relation to the crossing opening 31, the body 6 while moving exerting linear friction to the running surface of the reception wheel 39 to cause it to rotate. Though the reception wheel 39 supports the body 6 in an oblique angle (45 degrees) with respect to the traveling direction of the body 6 of the suspended vehicle 1, as shown in the drawing, the rotation and bearing capacity of the radial ball bearing 19*a* of the reception wheel 39 is completely invariant with those of the radial ball bearing 19 of the vertical wheel 15, thus assuring a smooth rotation and a sufficient load bearing capacity.

The contrivance in the vehicle body base 40, the wheel bottom walls 35 and the wheel mounting sections 17 of the suspended vehicle 1 have excellently overcome the problems in the prior art regarding the rail crossing sections, thereby enabling a smooth and reliable travel of heavy suspended panels.

Further, this invention enables a smooth and easy change in the panel traveling direction.

The present invention need not necessarily be limited to the above described embodiment, and, it is needless to say that various modifications can be achieved within the scope without departing from the gist of the present invention. For example, the number of the reception wheels could be four, instead of two.

What is claimed is:

1. A suspended travel device for panels comprising:

(A) suspended vehicles each comprising a square body, a through-hole extending from the top to the bottom surface of said body, a countersink formed on the top portion of said through-hole, with a diameter greater than that of said through-hole, a downwardly extending suspension axis passing said through-hole and supported by said body through the intermediary of a ball thrust bearing, guide grooves provided in said top surface of said body and crossing each other squarely in a lattice-like fashion, with said countersink surrounded by them, wheel mounting sections cut in the four side surfaces of said body, and two pairs of vertical wheels each rotatably mounted on an axle each provided in each of said wheel mounting sections;

(B) traveling rails each comprising a wheel sheath adapted to receive said body of said suspended vehicle, wheel bottom surfaces adapted to rotatably support said vertical wheels, rail base sections formed inside and below these wheel bottom surfaces, and a sliding groove in which said suspension axis travels; and (C) crossing rails provided at positions where said traveling rails cross each other in a cross-like fashion, comprising sliding grooves crossing each other at right angles with a crossing opening lying in the center and connected to said sliding grooves of the traveling rails, a crossing section wheel sheath adapted to receive said body of said suspended vehicle, wheel bottom walls substantially of the same height as said wheel bottom surfaces of the traveling rail, crossing rail base sections where these wheel bottom walls are arranged, and vehicle body bases provided in said crossing rail base sections, on which reception wheels are rotatably provided in such a manner that they support said body when said vertical wheels of said suspended vehicle move from said wheel bottom surfaces to said wheel bottom walls and which are arranged in a direction inclined with respect to the traveling direction of said body of said suspended vehicle.

2. A suspended travel device for panels as claimed in claim 1, wherein said reception wheels are arranged in a direction inclined approximately 45 degrees with respect to the traveling direction of said body of said suspended vehicle.

3. A suspended travel device for panels as claimed in claim 1, wherein each of said vehicle body bases comprises a small isosceles right triangular prism, an axle protruding from the base surface of this small triangular prism in a direction inclined with respect to the traveling direction of said body of said suspended vehicle, and a radial ball bearing rotatably supporting said reception wheel on this axle.

4. A suspended travel device for panels as claimed in claim 1, wherein only one pair of said two pairs of vertical wheels are supported by said wheel bottom surfaces to roll along said wheel bottom surfaces while said suspended vehicle is traveling, the other pair of vertical wheels remaining in a non-supported condition.

5. A suspended travel device for panels as claimed in claim 1, wherein said crossing rail includes guide projections protruding downwardly from the roof thereof, said guide projections being adapted to engage with said guide grooves of said body to guide the travel of said suspended vehicle when said suspended vehicle is traveling in said crossing rail.

6. A suspended travel device for panels comprising:

(A) suspended vehicles each comprising a parallelepiped body made of a hard material such as metal and having a horizontally elongated longitudinal section, a through-hole extending from the center of the top surface and passing the bottom surface of said body, a countersink cut as a flat cylindrical recess on the top portion of said through-hole and concentric with said through-hole and with a diameter greater than that of said through-hole, guide grooves with a rectangular longitudinal section cut in said top surface of said body, over the full length of said top surface, and crossing each other squarely in a lattice-like fashion with said countersink surrounded by them, thus defining crossing points where they cross each other, a downwardly extending suspension axis passing said through-hole and supported by said body through the intermediary of a ball thrust bearing, the top surface of said suspension axis being flush with the top surface of said body, said suspension axis being rotatably fixed in the bottom surface of said body, wheel mounting sections cut in the center of the four side surfaces of said body, in contact with or spaced from said guide grooves on both sides, said wheel mounting sections being cut inwardly and squarely with a depth corresponding to the width of a vertical wheel and extending from said top surface to said bottom surface of said body in a rectangular form, axles each protruding outwardly from the center of width of said wheel mounting sections, the ends of said axles being approximately flush with said side surfaces, and vertical wheels each of rotatably fixed to each said axles, said vertical wheels being approximately flush with said side surfaces and protruding beyond the bottom surface of the body, without being in contact with said guide grooves;

(B) traveling rails made of a hard material such as metal and composed of a transversely extending rail member with a U-shaped cross-section, open at the bottom in the longitudinal section, the side surfaces of said rail member being bent inwardly and squarely at the open bottom ends, to provide wheel bottom surfaces with a width slightly larger than that of the running surfaces of the vertical wheels of said suspended vehicle, said wheel bottom surfaces extending horizontally, leaving between them a space corresponding to the distance between the opposite wheel mounting sections of the body of said suspended vehicle, thereby forming a wheel sheath, the open ends of the wheel bottom surfaces being bent downwardly and squarely, to form lower side surfaces horizontally elongated, the open ends of the lower side surfaces being bent inwardly and squarely and allowed to extend horizontally, leaving between them a sliding groove with a width corresponding to the wheel diameter of the vertical wheels of said suspended vehicle and forming lower reception parts, said lower side surfaces and said lower reception parts forming rail base sections, or said lower reception parts being further bent at the open ends thereof downwardly and squarely and allowed to extend downwards with a length corresponding to a thickness of a ceiling panel, thus forming sliding groove walls, which may or may not be bent outwardly and squarely and allowed to slightly extend in the horizontal direction, forming a ceiling panel receiving section; and (C) crossing rails each generally composed as said traveling rails lying at right angles to each other, the sliding grooves crossing each other at right angles in cross form, with a crossing opening lying in the center, said side surfaces adjacent to each other extending downwardly, to form side surface extensions which are connected with said lower reception part extensions horizontally elongated, to form a crossing wheel sheath, wheel bottom walls rising from said reception part extensions and having a height and a width corresponding to that of said wheel bottom surface being provided in said crossing wheel sheath, said wheel bottom walls being connected flush with the wheel bottom surfaces of said traveling rails crossing each other and allowed to protrude, integrally with the side surface extensions, up to the vicinity of the sliding grooves to form crossing rail base sections, an axle protruding outwardly from the center of the triangular-cross-sectioned base surface of each small isosceles right triangular prism made of a hard material such as metal, a vehicle body base on which is mounted a vertical reception wheel with a radial ball bearing being mounted to said axle in such a manner that the vehicle body base is positioned inside a frame defined by the wheel bottom walls of said crossing rail base sections without protruding into the sliding grooves crossing each other, said body bases being provided two or four in number and opposite to said crossing opening or inversely oriented, the top surface of said small triangular prism being positioned considerably lower than the top surface of the wheel bottom wall, the reception wheel being rotatably fixed, protruding considerably higher than the top surface of the small triangular prism and situated above the lower reception part extension of the crossing rail base section, small cylindrical guide projections protruding into the crossing wheel sheath from the four corner portions of the roof of the rail crossing section, said small cylindrical guide projections protruding vertically being fixed in the positions corresponding to said crossing points in the guide grooves of the suspended vehicle when the suspension axis of the vehicle is positioned in said crossing opening;

(D) said traveling rails and said crossing rails being installed near a ceiling, the suspended vehicle in the traveling rail occupying approximately the entire space of said wheel sheath and running with its two transverse vertical wheels on said wheel bottom surfaces, respectively, and its two longitudinal vertical wheels being held in the air, the suspended vehicle moving to the crossing rail without being moved vertically, supported by said reception wheels in the crossing rail base sections, the crossing opening being reached with said guide projections positioned in the corresponding crossing points in said guide grooves and the vertical wheels positioned in the sliding grooves, a square turning of the suspended vehicle being effected with said longitudinal vertical wheels on the opposite wheel bottom walls, a straight movement of the suspended vehicle being effected with said transverse vertical wheels on the opposite wheel bottom walls, the vehicle running toward the wheel bottom surfaces, the body thereof then being gradually released from the support by the reception wheels.

* * * * *